US008764477B2

(12) United States Patent
Yang

(10) Patent No.: US 8,764,477 B2
(45) Date of Patent: Jul. 1, 2014

(54) PLUG WIRE TYPE LAMPHOLDER

(75) Inventor: Wen Ho Yang, New Taipei (TW)

(73) Assignee: Rich Brand Industries Limited, Dongguan, Guangdong Province (CN)

( * ) Notice: Subject to any disclaimer, the term of this patent is extended or adjusted under 35 U.S.C. 154(b) by 80 days.

(21) Appl. No.: 13/494,198

(22) Filed: Jun. 12, 2012

(65) Prior Publication Data

US 2013/0330958 A1 Dec. 12, 2013

(51) Int. Cl.
*H01R 4/24* (2006.01)

(52) U.S. Cl.
USPC ..... 439/439; 439/505

(58) Field of Classification Search
USPC ..... 439/439, 440, 441, 505
See application file for complete search history.

(56) References Cited

U.S. PATENT DOCUMENTS 3,206,710 A * 9/1965 McLaughlin ..... 439/441
3,324,447 A * 6/1967 Pistey ..... 439/441
3,417,368 A * 12/1968 Norden ..... 439/577
3,646,582 A * 2/1972 Van Alphen et al. ..... 439/441
3,979,615 A * 9/1976 Neff ..... 310/71
4,952,167 A * 8/1990 Hertelendy ..... 439/395
5,205,757 A * 4/1993 Hertelendy ..... 439/441
5,626,488 A * 5/1997 Albeck et al. ..... 439/395
6,280,233 B1 * 8/2001 Beege et al. ..... 439/441
6,548,761 B1 * 4/2003 Wang ..... 174/74 R
6,746,286 B2 * 6/2004 Blaha ..... 439/787
7,175,469 B1 * 2/2007 Daily et al. ..... 439/441
7,246,778 B2 * 7/2007 Caveney et al. ..... 248/68.1

* cited by examiner

*Primary Examiner* — Thanh Tam Le
(74) *Attorney, Agent, or Firm* — Bacon & Thomas, PLLC

(57) ABSTRACT

A plug-wire type lampholder comprises an acting body having a set of slots formed in the acting body and provided for installing a wire clamping plate separately, and the wire clamping plate has at least one end bent to form two into movable plates, and each slot has two notches and different notches are separated with an interval apart, so that when the wire clamping plate is installed into the slot, the movable plates remain in different corresponding notches respectively, and in different notches the same slot are provided for plugging bare ends of different electric wires respectively to achieve an electric conduction, so as to facilitate connecting lamps of different plug-wire type lampholders into a lamp string quickly.

5 Claims, 10 Drawing Sheets

PLUG WIRE TYPE LAMPHOLDER

BACKGROUND OF THE INVENTION

1. Field of the Invention

The present invention relates to a plug-wire type lampholder, and more particularly to the plug-wire type lampholder used for connecting lamps into a lamp string quickly and conveniently.

2. Description of the Related Art

Lampholder is an apparatus provided for installing a light emitting device (such as a bulb, a halogen bulb, an energy-saving bulb, a power-saving bulb or an LED bulb) and connecting to an electric wire and a power supply for powering on and off the light emitting device.

In general, the lampholder includes an acting body, an electric wire connected upwardly to the acting body, and a light emitting device installed downwardly. To control the ON and OFF of the light emitting device, the lampholder is mainly divided into two types: a switch type lampholder and a switchless lampholder. The so-called switch type lampholder generally includes a switch mechanism installed in the acting body, and coupled to a switch control device (a knob, a tact or pull-chain wireless remote controller to facilitate users to control closing or opening the switch mechanism by the switch control device, so as to turn OFF or ON the power supply and control the ON or OFF of the light emitting device. The so-called switchless lampholder is a lampholder without any switch mechanism or switch control device installed in the acting body, and the switch for turning on or off the power is installed on an electric wire, so that the switch can control opening or closing the power supply to control the ON and OFF of the light emitting device.

At early stage, most lampholders are screw-type lampholders connected to an electric wire by screwing such as the switchless screw-type lampholder 10 as shown in FIG. 1, the knob switch screw-type lampholder 11 as shown in FIG. 2, the tact switch screw-type lampholder 12 as shown in FIG. 3 and the pull-chain switch screw-type lampholder 13 as shown in FIG. 4, and all of these lampholders have a set of installed on the acting body 16 and connected to the electric wire 18 by screwing. However, these lampholders have the drawbacks that it is relatively troublesome to connect the screw element 17 to the electric wire by screwing, and the stability of the connection is relatively lower.

To overcome the aforementioned drawbacks of the conventional screw-type lampholder, plug-wire type lampholders connected to an electric wire by plugging are introduced. These plug-wire type lampholders can be the switchless plug-wire type lampholder 20 as shown in FIG. 5, the knob switch type plug-wire type lampholder 21 as shown in FIG. 6, the tact switch plug-wire type lampholder 22 as shown in FIG. 7 and the pull-chain switch plug-wire type lampholder 23 as shown in FIG. 8. With reference to FIGS. 9 to 11, a set of slots 27 is installed in the acting body 26 for installing wire clamping plates 29 respectively (as shown in FIGS. 9 and 10), and an end of the wire clamping plate 29 is bent 90 degrees to form a movable plate 291, whose edge is punched to form a concave V-shaped wire clamping hook 292. After the assembling, the movable plate 291 remains at a notch 271 of the slot 27 (as shown in FIG. 9). Since the wire clamping plate 29 is mainly used for connecting other components to the power supply, therefore the other end can be a conductive terminal in any shape depending on actual requirements and used for conductively connecting other components. In FIG. 11, a bare end of the electric wire 28 is plugged into the corresponding notch 271 of the slot 27 during use, and the bare end of the electric wire 28 will be contacted first and the movable plate 29 touches the V-shaped wire clamping hook 292, and then a force can be applied to push the electric wire 28, such that the movable plate 291 will be bent inwardly and deformed temporarily, and the bare end of the electric wire 28 can be extended into the slot 27. When the pushing force applied to the electric wire 28 is released, the elastic restoring force of the movable plate 291 pops the V-shaped wire clamping hook 292 up slightly in an opposite direction to hook the bare end of the electric wire 28 and work together with the inner wall of the slot 27 to clamp the bare end of the electric wire 28, so that both terminals of a power supply are respectively and electrically conducted to two wire clamping plates 29 through two electric wires 28 and further conducted to other components.

The structure with the slot 27 and the wire clamping plate 29 of the conventional plug-wire type lampholder can be used to achieve the effects of plugging the bare end of the electric wire 28 quickly, and improving the stability of the connection. Although such structure is a good light emitting tool, it still has the following drawback. The conventional plug-wire type lampholder cannot be used for connecting lamps into a lamp string directly, so that each lampholder is plugged with an end of an electric wire and the other end is connected in series in order to have a lamp string. Obviously, such connecting process is too complicated and the safety is relatively lower, and thus the conventional structure requires improvements.

SUMMARY OF THE INVENTION

In view of the aforementioned drawbacks of the prior art, the inventor of the present invention based on years of experience in the related industry to conduct extensive researches and experiments, and finally developed a plug-wire lampholder to overcome the drawbacks of the prior art.

Therefore, it is a primary objective of the present invention to provide a plug-wire type lampholder capable connecting lamps into a lamp string quickly and conveniently.

To achieve the foregoing objective, the present invention provides a plug-wire type lampholder comprising: an acting body, installed the lampholder, and having a set of slots formed therein and provided for installing a wire clamping plate; and a movable plate, formed by bending at least one end of the wire clamping plate, and the movable plate remaining in a notch of the slot when the wire clamping plate is installed into the slot; such that when use, a bare end of an electric wire is plugged into the corresponding notch of one of the slots, such that the bare end touches the movable plate first and forces the movable plate to be bent inwardly and deformed temporarily, and the bare end of the electric wire is extended into the slot, and when the action of plugging the electric wire ends, an elastic restoring force of the movable plate pops the movable plate up slightly in an opposite direction and works together with an inner wall of the slot to clamp the bare end of the electric wire; characterized in that two movable plates of the wire clamping plate are installed, and when the wire clamping plate is installed in the slot, the movable plates remain into the notches of the slot, and the movable plates are provided for clamping different electric wires respectively to achieve the effect of connecting different electric wires to a power supply.

In the plug-wire type lampholder, the movable plate has a substantially concave V-shaped wire clamping hook formed at an edge of the movable plate.

In the plug-wire type lampholder, the bare end of the electric wire reaches the position of the wire clamping hook when the bare end of the electric wire is plugged into the corresponding notch of the slot.

In the plug-wire type lampholder, the wire clamping hook and an inner wall of the slot jointly clamp the bare end of the electric wire bare end when the movable plate pops up slightly in an opposite direction.

In the plug-wire type lampholder, each slot includes two notches, and different notches are separated with an interval apart, so that different notches are disposed corresponding to different movable plates respectively.

DETAILED DESCRIPTION OF THE PREFERRED EMBODIMENTS

The technical characteristics and effects of the present invention will become apparent with the detailed description of preferred embodiment accompanied with the illustration of related drawings as follows.

Figure 2:
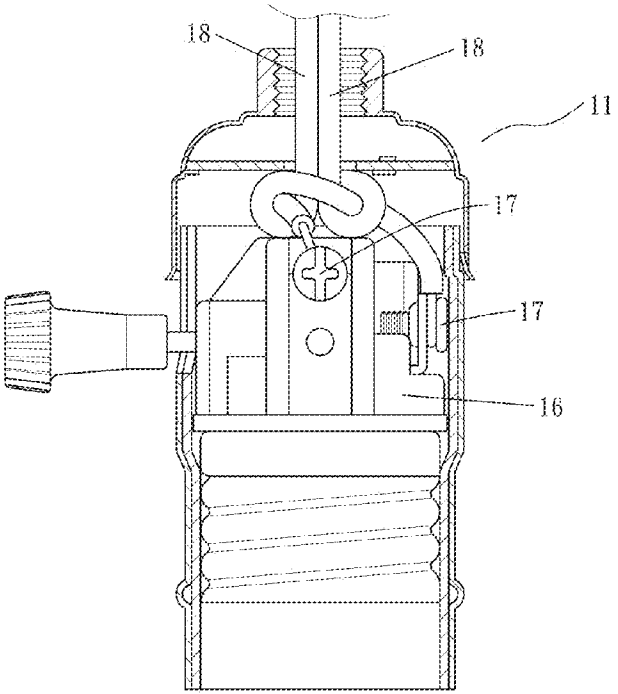
FIG. 2 (PRIOR ART)
FIG. 2 is a cross-sectional view of a conventional knob switch screw-type lampholder.
Figure 1:
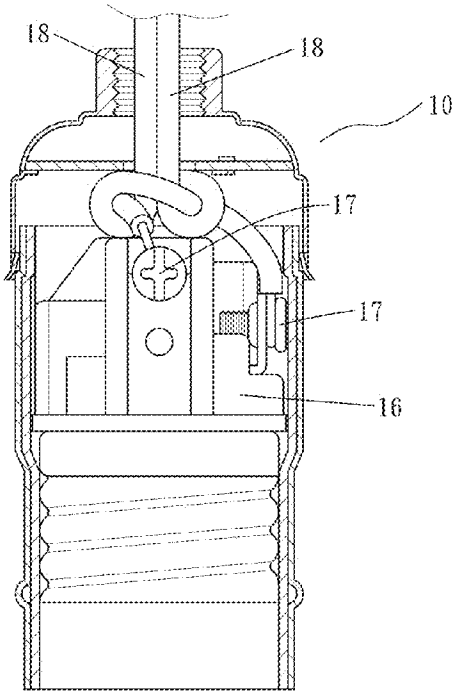
FIG. 1 (PRIOR ART)
FIG. 1 is a cross-sectional view of a conventional switchless screw-type lampholder.
Figure 4:
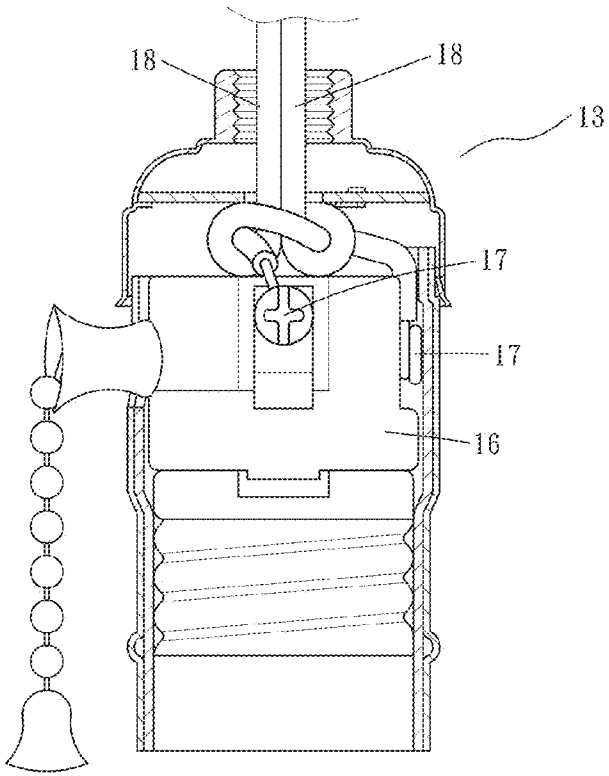
FIG. 4 (PRIOR ART)
FIG. 4 is a cross-sectional view of a conventional pull-chain switch screw-type lampholder.
Figure 3:
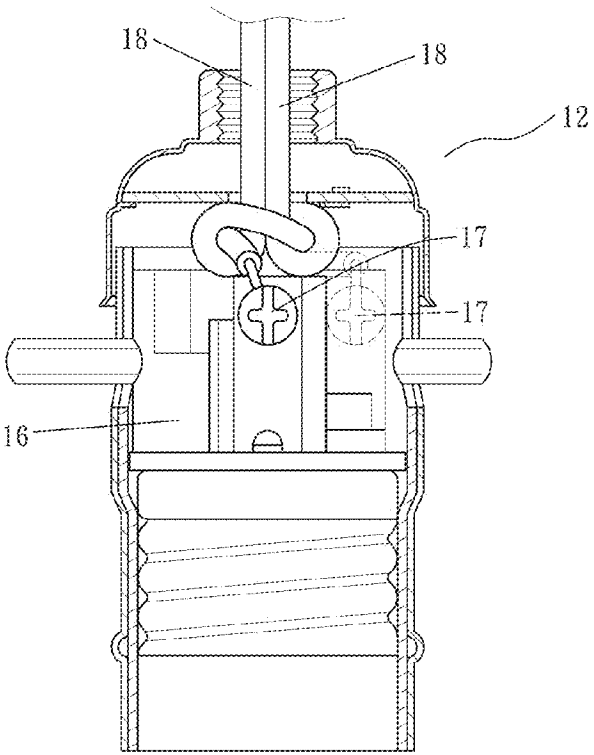
FIG. 3 (PRIOR ART)
FIG. 3 is a cross-sectional view of a conventional tact switch screw-type lampholder.
Figure 6:
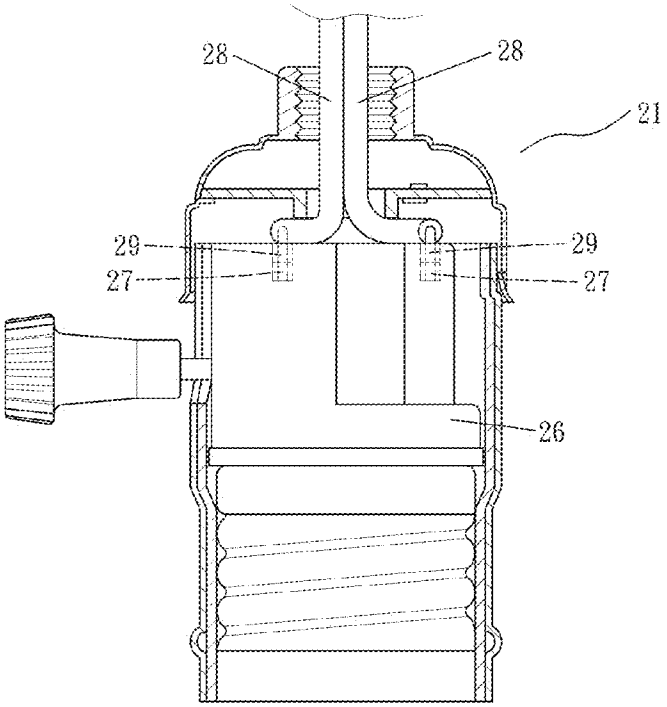
FIG. 6 (PRIOR ART)
FIG. 6 is a cross-sectional view of a conventional knob switch plug-type lampholder.
Figure 5:
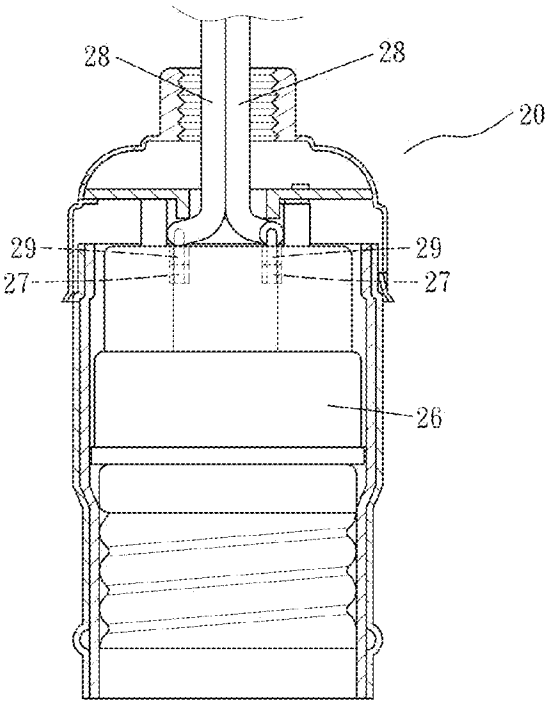
FIG. 5 (PRIOR ART)
FIG. 5 is a cross-sectional view of a conventional switchless plug-type lampholder.
Figure 8:
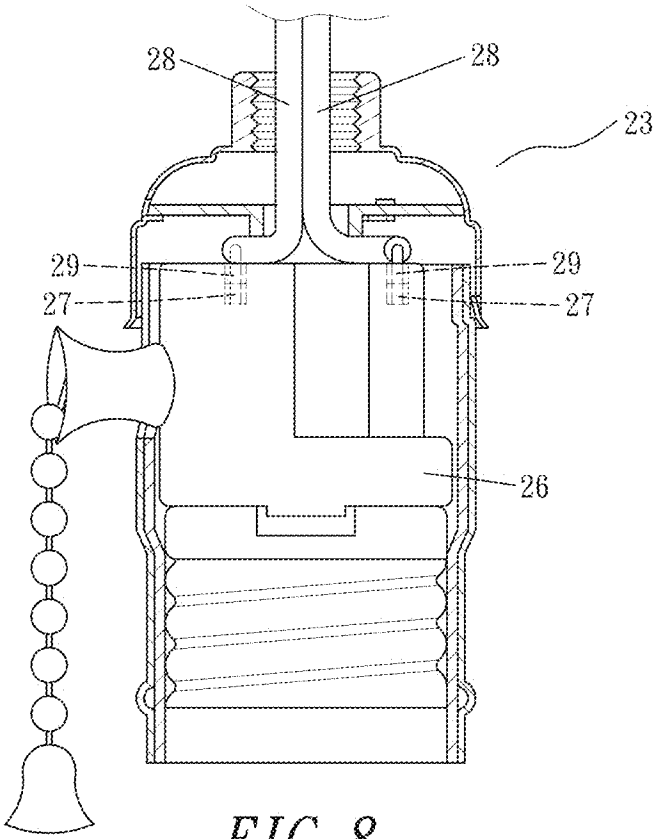
FIG. 8 (PRIOR ART)
FIG. 8 is a cross-sectional view of a conventional pull-chain switch plug-type lampholder.
Figure 7:
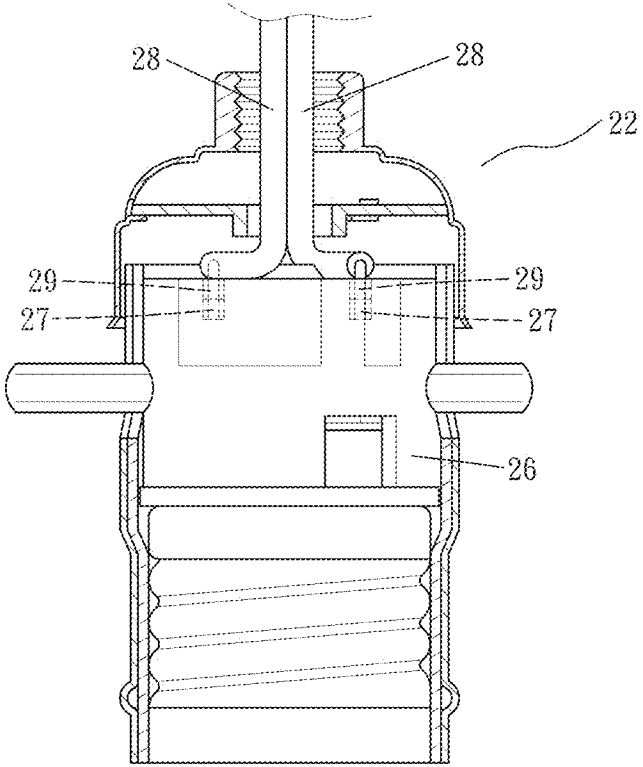
FIG. 7 (PRIOR ART)
FIG. 7 is a cross-sectional view of a conventional tact switch plug-type lampholder.
Figure 10:
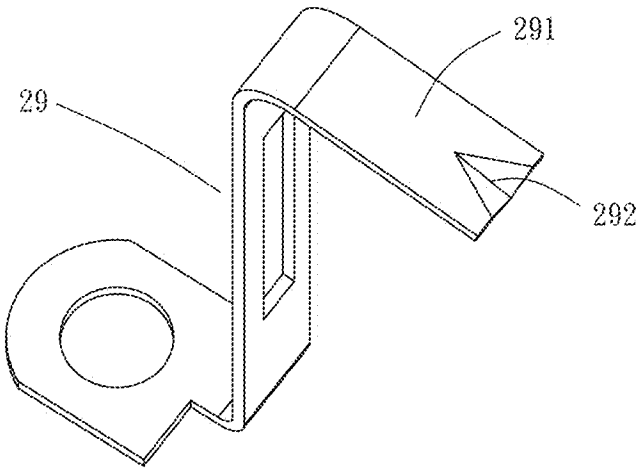
FIG. 10 (PRIOR ART)
FIG. 10 is a perspective view of a wire clamping plate in a conventional plug-type lampholder.
Figure 9:
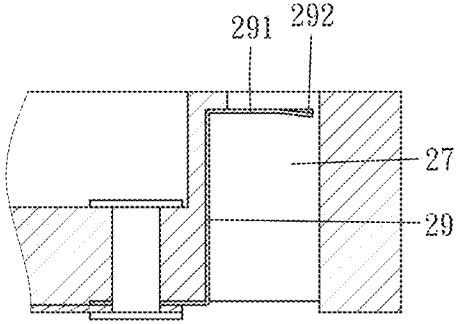
FIG. 9 (PRIOR ART)
FIG. 9 is a schematic view of installing an acting body and a wire clamping plate in a conventional plug-type lampholder.
Figure 12:
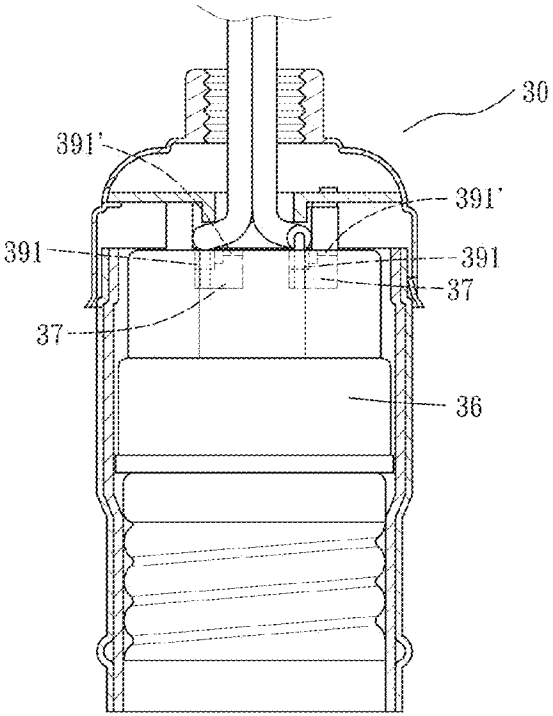
FIG. 12 is a cross-sectional view of the present invention applied as a switchless plug-type lampholder.
Figure 11:
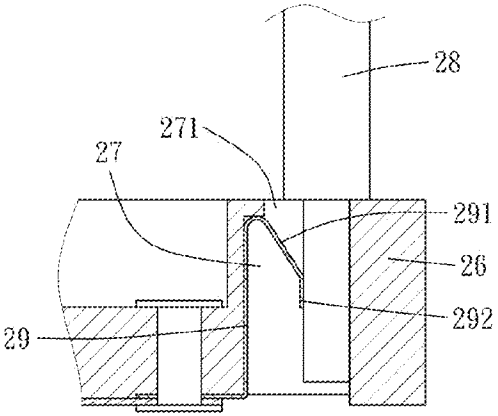
FIG. 11 (PRIOR ART)
FIG. 11 is a schematic view of actions of a wire clamping plate in a conventional plug-type lampholder.
Figure 14:
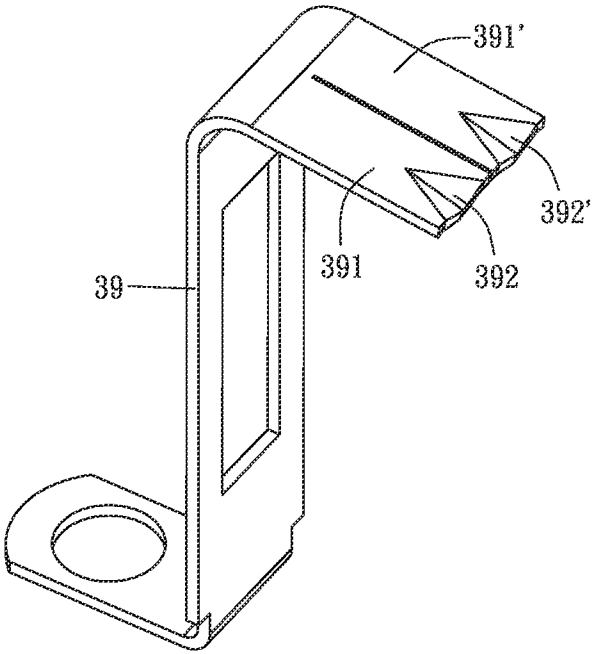
FIG. 14 is a perspective view of a wire clamping plate in accordance with a preferred embodiment of the present invention.
Figure 13:
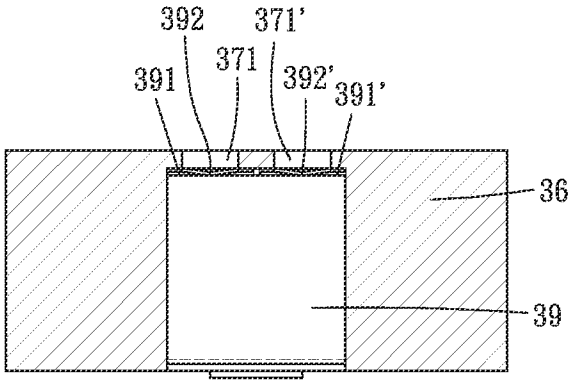
FIG. 13 is a schematic view of installing an acting body and a wire clamping plate in accordance with a preferred embodiment of the present invention.

With reference to FIG. 12 for a switchless plug-wire type lampholder 30 in accordance with a preferred embodiment of the present invention, the switchless plug-wire type lampholder 30 includes an acting body 36 installed therein and having a set of slots 37 formed in the acting body 36 and provided for installing a wire clamping plate 39 separately. With reference to FIGS. 13 and 14, when an end of the wire clamping plate 39 is bent to approximately 90 degrees to form a set (or two) of movable plates 391, 391', and an edge of each movable plate 391, 391' is punched into a substantially concave V-shaped wire clamping hook 392, 392', so that after the movable plates 391, 391' are assembled, the movable plates 391, 391' remain in the notches 371, 371' of the slot 37 respectively. To facilitate aligning with different movable plates 391 and 391', the notches 371, 371' are separated with an interval apart. In other words, each acting body 36 has a set (or two) of slot 37, and each slot 37 has two notches 371, 371' corresponding to different movable plates 391 and 391' respectively.

Figure 15:
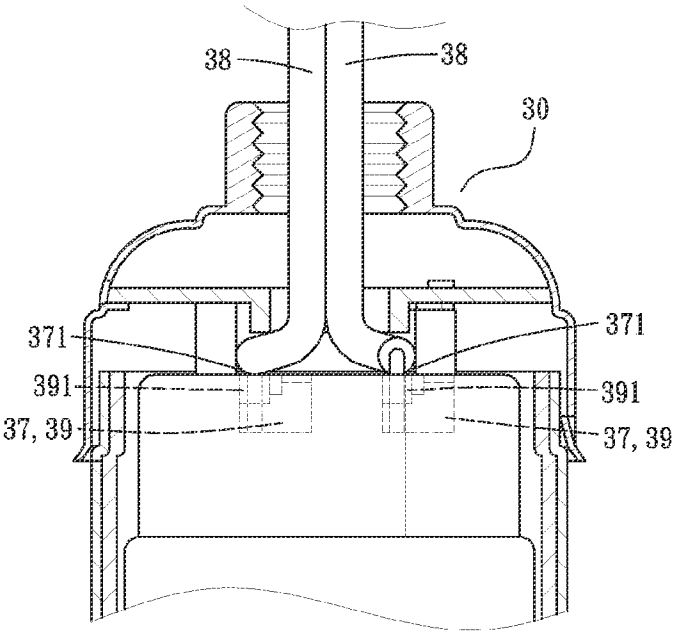
FIG. 15 is a schematic view of an action of a wire clamping plate in accordance with a preferred embodiment of the present invention.

When the plug-wire type lampholder 30 is used, the movable plates 391, 391' of the wire clamping plate 39 and the electric wires 38, 38' can be connected with one another in the following ways:

1. When only one plug-wire type lampholder 30 is used as shown in FIG. 15, a bare end of an electric wire 38 (or 38') is plugged into a corresponding notch 371 of a slot 37. The bare end of each electric wire 38 (or 38') touches one of the movable plates 391 (or 391') of the of the wire clamping plate 39 first and reaches the position of a V-shaped wire clamping hook 392 (or 392'). When a force is applied to push the electric wire 38 (or 38') into the notch 371, the movable plate 391 (or 391') is forced to bent inwardly and deform temporarily, such that the bare end of the electric wire 38 (or 38') can be extended into the slot 37. When the force applied to the electric wire 38 (or 38') is released, an elastic restoring force of the movable plate 391 (or 391') drives the V-shaped wire clamping hook 392 (or 392') to pop up in slightly in an opposite direction to hook the bare end of electric wire 38 (or 38'), so that the movable plate 391 (391') together with an inner wall of the slot 37 clamp the bare end of the electric wire 38 (or 38'). As a result, two terminals of the power supply are conducted to two wire clamping plates 39 through two electric wires 38 (or 38') respectively and further conducted to other components. Finally, the light emitting device installed to the plug-wire type lampholder 30 is lit.

Figure 16:
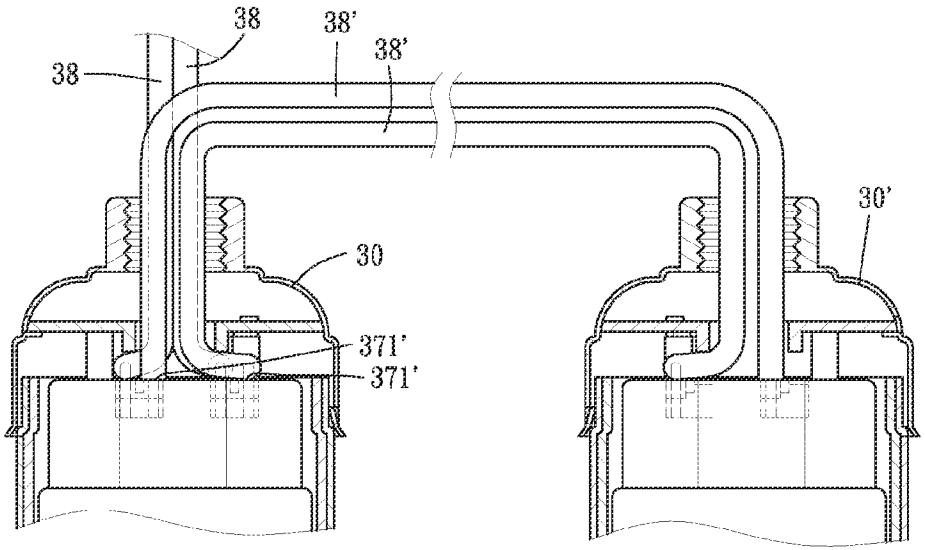
FIG. 16 is a schematic view of an action of a wire clamping plate for a serial connection in accordance with a preferred embodiment of the present invention.

2. When the action as shown in FIG. 15 is completed, the plug-wire type lampholder 30 can be connected to a second (another) plug-wire type lampholder 30' quickly as shown in FIG. 16. Bare ends at both ends of the other electric wires 38', 38 are plugged into other notches 371', 371 of slots 37 of two different plug-wire type lampholders 30, 30' respectively, and then a force is applied to both bare ends of the electric wires 38', 38 to push the V-shaped wire clamping hooks 392', 392 of the touched movable plates 391', 391 and extend them into the slots 37 respectively. When the force is released, the V-shaped wire clamping hooks 392', 392 and the inner walls of the slots 37 jointly clamp the bare ends of the electric wires 38', 38 respectively, so that the power supply can be connected to the second (other) plug-wire type lampholder 30' through the electric wire 38' (or 38). Finally, the light emitting devices installed to the plug-wire type lampholders 30, 30' are lit, and the two plug-wire type lampholders are connected into a lamp string.

3. With the aforementioned serial connection, several plug-wire type lampholders can be connected in series into a lamp string conveniently and quickly.

Figure 18:
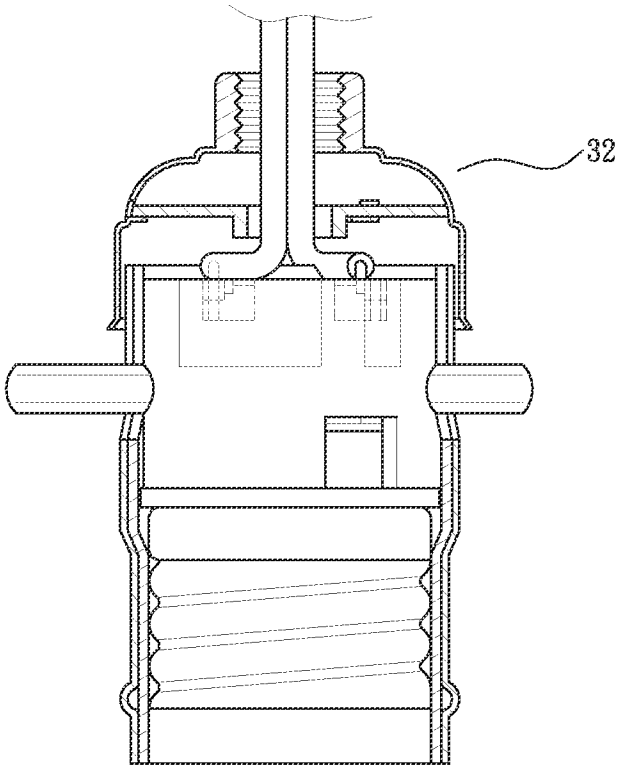
FIG. 18 is a cross-sectional view of the present invention applied as a tact switch plug-type lampholder.
Figure 17:
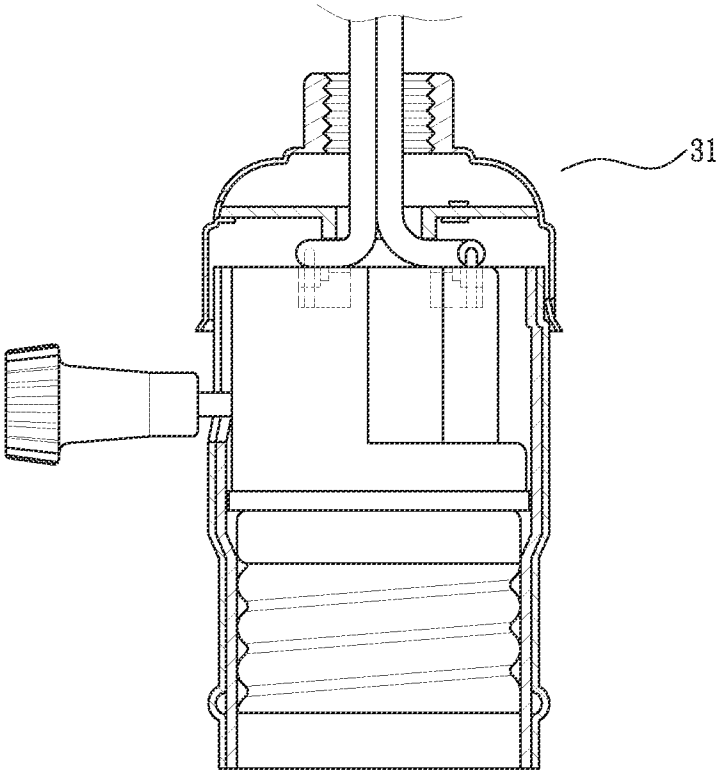
FIG. 17 is a cross-sectional view of the present invention applied as a knob switch plug-type lampholder.
Figure 19:
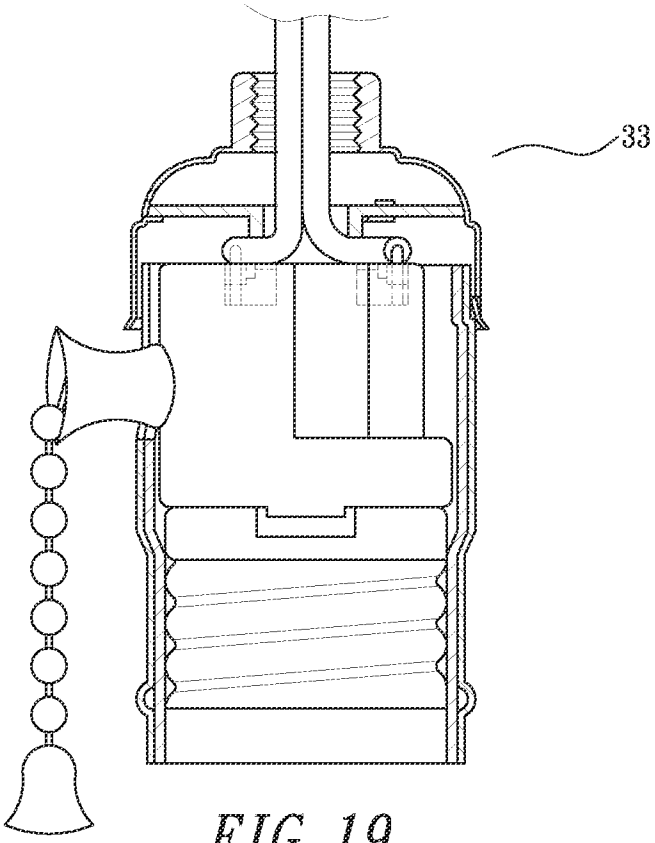
FIG. 19 is a cross-sectional view of the present invention applied as a pull-chain switch plug-type lampholder.

The present invention is characterized in that the wire clamping plate installed in the plug-wire type lampholder has a set (two) of movable plates for plugging different electric wires at the same time, so as to facilitate users to connect the power supply of the first plug-wire type lampholder to the second plug-wire type lampholder. With the same serial connection, several plug-wire type lampholders can be connected in series to form a lamp string easily and quickly. Therefore, the present invention can be applied to lampholders of any shape or any structural form. In other words, the present invention can be applied in a switchless plug-wire type lampholder 30 as shown in FIG. 12, a knob switch plug-wire type lampholder 31 as shown in FIG. 17, a tact switch plug-wire type lampholder 32 as shown in FIG. 18 or a pull-chain switch plug-wire type lampholder 33 as shown in FIG. 19 to achieve the same effect of connecting several plug-wire type lampholders in series into a lamp string conveniently and quickly. Although there are many plug-wire type lampholder available in the market, the present invention is characterized in that the acting body installed the lampholder of the present invention has the wire clamping plates for connecting different electric wires to achieve the effect of connecting a number of plug-wire type lampholders serially into a lamp string conveniently and easily.

From the description above, the present invention can connect different plug-wire type lampholders to a power supply conveniently and quickly by a simple plugging action. Compared with the conventional plug-wire type lampholder as shown in FIG. 5 to 8, the plural plug-wire type lampholders of the present invention can be connected into a lamp string easily. In summation of the description above, the present invention improves over the prior art and complies with the patent application requirements, and this is duly filed for patent application.

What is claimed is:

1. A plug-wire type lampholder, comprising:

a light emitting device holding body installed on the lampholder, said light emitting device holding body having a set of slots formed therein and provided for installing a wire clamping plate; and said wire clamping plate comprising at least two movable plates, said wire clamping plate connected to the light emitting device holding body, said at least two movable plates formed by bending at least a first end of the wire clamping plate, wherein each of the movable plates remain in a notch of a slot of the set of slots when the wire clamping plate is installed into the slot, wherein said at least two movable plates are each configured in a way such that when a bare end of an electric wire is plugged into the notch of the slot, the bare end first touches the movable plate and forces the movable plate to be bent inwardly and deformed temporarily, and the bare end of the electric wire is extended into the slot, and when the action of plugging of the electric wire ends, an elastic restoring force of the movable plate pops the movable plate up slightly in an opposite direction and works together with an inner wall of the slot to clamp the bare end of the electric wire, wherein the at least two movable plates are configured in a way such that the at least two movable plates clamp different electric wires respectively to achieve the effect of connecting different electric wires to a power supply.

2. The plug-wire type lampholder of claim 1, wherein each of the movable plates has a substantially concave V-shaped wire clamping hook formed at an edge of the movable plate.

3. The plug-wire type lampholder of claim 2, wherein the bare end of the electric wire reaches the position of the wire clamping hook when the bare end of the electric wire is plugged into the corresponding notch of the slot.

4. The plug-wire type lampholder of claim 2, wherein the wire clamping hook and the inner wall of the slot jointly clamp the bare end of the electric wire bare end when the movable plate pops up slightly in the opposite direction.

5. The plug-wire type lampholder of claim 1, wherein each slot includes two notches, and said two notches are separated with an interval apart, so that each of said two notches is disposed corresponding to each of said two movable plates; respectively.

* * * * *